US005171135A

United States Patent [19]

Gannaway et al.

[11] Patent Number: 5,171,135

[45] Date of Patent: Dec. 15, 1992

[54] FLEXIBLE SUCTION VALVE RETAINER

[75] Inventors: Edwin L. Gannaway, Adrian; George W. Gatecliff, Saline; Arturo L. Ortiz, Tecumseh, all of Mich.

[73] Assignee: Tecumseh Products Company, Tecumseh, Mich.

[21] Appl. No.: 735,434

[22] Filed: Jul. 25, 1991

[51] Int. Cl.[5] ..... F04B 21/04; F16K 31/00

[52] U.S. Cl. ..... 417/550; 251/64

[58] Field of Search ..... 417/545, 550, 552; 137/514; 251/64

[56] References Cited

U.S. PATENT DOCUMENTS

| | | | |
|---|---|---|---|
| 1,147,350 | 7/1915 | Wikander | 137/516.23 |
| 3,944,381 | 3/1976 | Dirk | 417/564 |
| 4,785,721 | 11/1988 | Leigh-Monstevens et al. | 92/171 |
| 4.834,632 | 5/1989 | Gatecliff | 417/534 |
| 5,080,565 | 1/1992 | Schultz | 417/550 |

*Primary Examiner*—Leonard E. Smith
*Assistant Examiner*—Roland McAndrews
*Attorney, Agent, or Firm*—Baker & Daniels

[57] ABSTRACT

A flexible valve retainer for a piston and suction valve assembly of a reciprocating piston hermetic compressor assembly. In the compressor assembly, the suction valve opens as a result of the fluid pressure generated by the reciprocating movement of the piston in the cylinder. As it opens, the suction valve is axially displaced from a closed position on the top surface of the piston to an open position a fixed distance therefrom, whereupon further axial movement is prevented as the suction valve strikes the valve retainer. The radially outer portion of the valve retainer deflects as a result of the impact with the suction valve. This deflection of the valve retainer lessens the detrimental effects caused by repeated impact between the suction valve and retainer. The valve retainer is formed from a flexible material such as spring steel or Swedish steel. The valve retainer comprises at least one washer coaxial with the suction valve, and spaced said fixed distance therefrom. In a preferred embodiment, the valve retainer comprises two or three washers stacked one atop another. The stiffness of the valve retainer is less than about 331,000 lbf/in, and the thickness of the valve retainer is preferably between about 0.028 and 0.060 inch.

22 Claims, 2 Drawing Sheets

FLEXIBLE SUCTION VALVE RETAINER

BACKGROUND OF THE INVENTION

The present invention relates generally to a reciprocating piston compressor assembly and, more particularly, to an improved suction valve retainer in a piston and valve assembly for such a compressor assembly.

In a typical reciprocating piston compressor, a cylinder is defined by a compressor crankcase and a piston reciprocates within the cylinder to compress gaseous refrigerant therein. In a compressor to which the present invention generally pertains, the piston comprises a piston valve assembly wherein a suction valve is operably mounted to the piston head to receive gaseous refrigerant through the piston from one end of the cylinder, whereupon the gas is compressed in the cylinder and thereafter discharged. A valve plate may be mounted to the crankcase so as to close the top of the cylinder. The valve plate includes a discharge valve assembly operable to discharge gas into a discharge space defined by a cylinder head cover mounted to the crankcase with the valve plate disposed therebetween.

A scotch yoke compressor includes a suction cavity defined within the crankcase into which a plurality of radially disposed cylinders open. A crankshaft is journalled in the crankcase and includes an eccentric portion located in the suction cavity to which the pistons and cylinders are operably coupled by means of a scotch yoke mechanism. In a typical scotch yoke coupling mechanism, where four radially disposed pistons are attached to a pair of U-shaped yokes, the piston bodies are attached to the yokes by means of threaded bolts, rivets, and the like. In addition, separate means are provided for retaining the suction valve component to the piston head. Such valve attachment means may comprise bolts, rivets, bosses, and the like. The provision of separate means for attaching the piston member to the scotch yoke and for attaching suction valving to the piston head requires a plurality of parts and entails a higher degree of difficulty during compressor assembly.

In a compressor assembly having a piston valve assembly, as herein described, the suction valve is mounted generally adjacent the top surface of the piston head and is reciprocatingly displaceable from a closed position adjacent the piston head to an open position a fixed distance from the piston head. A valve retainer is axially spaced a fixed distance from the piston head, to limit the displacement of the suction valve. In one prior art compressor, the suction valve is reciprocatingly displaced approximately 0.060 inch from the top of the piston head to the valve retainer. As the valve strikes the retainer, a relatively large amount of stress is placed on the retainer and valve. In order to avoid damage to this retainer, it has been necessary in prior art systems to provide a retainer having sufficient strength to resist this stress. Such retainers have generally been formed from a material having sufficient strength to withstand the stresses, or from a material having sufficient thickness such that the effect of the stress on the retainer would be minimized.

While prior art valve retainers are generally effective in limiting the valve displacement, the life of the retainer and valve may nevertheless be adversely affected as a result of an accumulation of stress cycles on the retainer and valve caused by the repeated impact of the two parts. This accumulation of stress cycles may cause a breakdown of the retainer and valve, resulting in the loss of use of the compressor assembly. Therefore, it is desired to provide a valve retainer having an improved capability for withstanding these stresses and reducing stress on the suction valve, and accordingly, having a longer life than prior art retainers and valves.

A particular prior art retainer of the type shown in U.S. Pat. No. 4,834,632 included a valve retainer approximately 0.060 inches thick and made of spring steel. Although this retainer had some flexibility, it was still not satisfactory, especially for large capacity compressors.

SUMMARY OF THE INVENTION

The present invention overcomes the disadvantages of the above-described prior art valve systems for reciprocating piston compressors incorporating system valve assemblies, by providing an improved valve retainer therefore. The valve retainer is formed from a flexible material and has a reduced thickness, whereby the radially outer portion of the retainer is deflected upon impact with the suction valve. As a result, the stresses on the valve and valve retainer are reduced when compared to the stresses on prior art more rigid valve retainers, thereby increasing the longevity of the retainer and valve.

An advantage of present invention is that the improved flexible valve retainer is better able to withstand the stress and absorb the impact caused by the impact with the suction valve than prior art retainers, thereby increasing the useful life of the piston and valve assembly over the prior art.

Another advantage of the present invention is that the piston and valve assembly requires less maintenance than prior art systems, as a result of the lessened chance of failure of the flexible valve retainer and suction valve when compared to prior art retainers.

A further advantage of the piston and valve assembly of the present invention is that the flexible valve retainer is formed from readily available materials, thus providing an improved compressor assembly at a favorable cost.

Yet another advantage of the present invention is that the operating cost of the compressor assembly may be reduced over prior art assemblies.

Still another advantage of the present invention is that the compressor assembly may operate at a lower noise level when compared to prior art assemblies.

The piston and valve assembly for a hermetic compressor of the present invention, in one form thereof, comprises a crankcase including a cylinder therein. A piston reciprocable in the cylinder is provided. A valve member is disposed generally adjacent the top surface of the piston, and is displaceable a fixed distance therefrom. Flexible valve retainer means having a thickness less than about 0.060 inch, and a stiffness less than about 331,000 lbf/in are spaced this fixed distance from the piston top surface.

The present invention, in another form thereof, comprises a piston and valve assembly for a hermetic compressor. The compressor includes a crankcase having a cylinder therein, and further includes a suction cavity defined by an inside wall of the crankcase. The piston and valve assembly further comprises a piston reciprocable in the cylinder for compressing gaseous refrigerant therein. The piston has a plurality of suction ports extending therethrough from a top surface to a bottom surface thereof, whereby the gaseous refrigerant passes into the cylinder from the suction cavity by way of the suction ports. A suction valve member is operably mounted to the top surface and is coaxial therewith. The suction valve member is axially displaceable from a closed position adjacent the top surface, where the suction ports are covered by the valve member, to an open position axially spaced a fixed distance from the top surface. The cylinder is in fluid communication with the suction cavity when the suction valve member is in the open position. Flexible valve stop means are axially spaced this fixed distance from the top surface. The valve stop means are sized and configured to limit the displacement of the suction valve member from the closed position to the open position as a result of impact therebetween. The valve stop means further has a radially outer portion and a radially inner portion, the radially outer portion being deflectable upon said impact, and having a stiffness that increases with an increase in deflection, said stiffness being less than about 331,000 lbf/in. Means in registry with the piston and valve stop means are also provided for maintaining the valve stop means at the fixed distance from the piston top surface.

In one preferred embodiment, the flexible valve stop means described above comprises a plurality of generally annular washers, for example, two or three washers, stacked one atop another, wherein the plurality of washers has preferably an aggregate thickness of 0.060 inch or less. In a particularly preferred embodiment, the flexible valve stop means comprises three generally annular washers stacked one atop another. The washers each have a thickness of about 0.020 inch, and have an aggregate stiffness of less than about 51,000 lbf/in.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
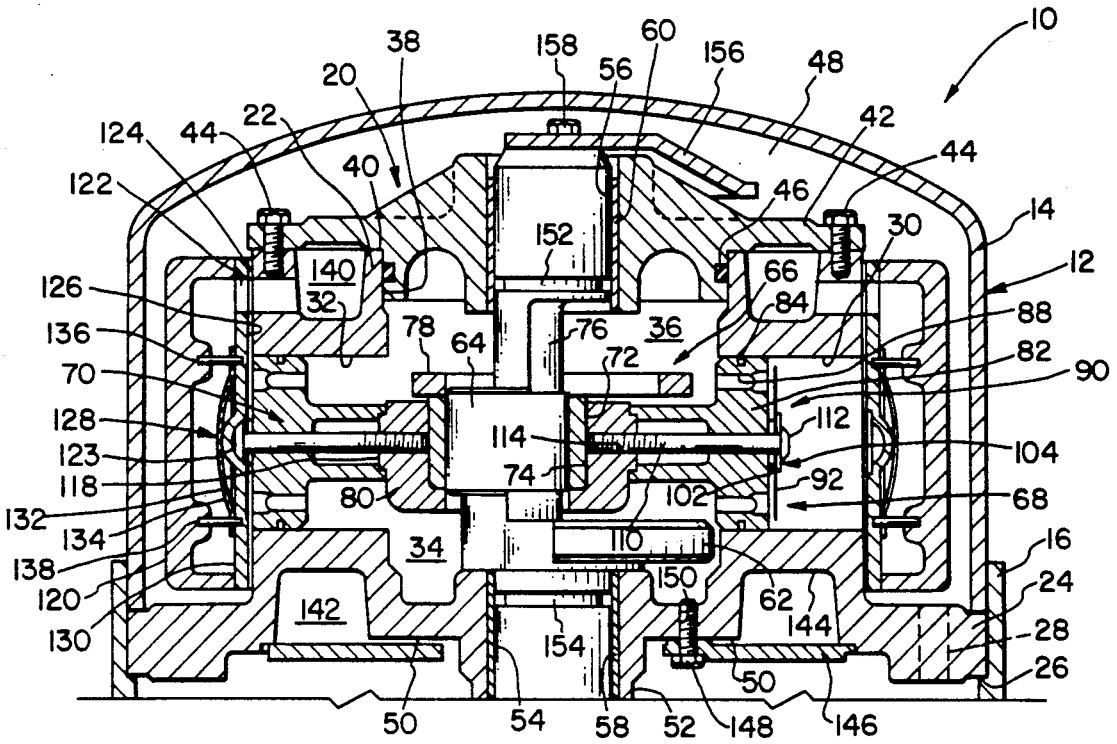
FIG. 1 is a side sectional view of a portion of a compressor of the type to which the present invention pertains.

Corresponding reference characters indicate corresponding parts throughout the several views. The exemplifications set out herein illustrates preferred embodiments of the invention, in two forms thereof, and such exemplifications are not to be construed as limiting the scope of the invention in any manner.

DESCRIPTION OF THE PREFERRED EMBODIMENT

In an exemplary embodiment of the invention as shown in the drawings, and in particular by referring to FIG. 1, an upper portion of a compressor assembly 10 is shown. This compressor assembly is substantially similar to the one disclosed and described in greater detail in U.S. Pat. No. 4,834,632, assigned to the same assignee as the present invention, the disclosure of which is incorporated herein by reference. Compressor assembly 10 includes a housing 12 having an upper portion 14, a central portion 16 and a lower portion (not shown). The housing portions are hermetically secured together as by welding or brazing.

A compressor mechanism 20 is enclosed within housing 12. Compressor mechanism 20 comprises a crankcase 22 including a circumferential mounting flange 24 axially supported within an annular ledge 26 in central portion 16 of the housing. A bore 28 extends through flange 24 to provide communication between the top and bottom ends of housing 12 for return of lubricating oil and equalization of discharge pressure within the entire housing interior in a manner well known to those skilled in the art.

Compressor mechanism 20, in the embodiment illustrated in the drawings, takes the form of a reciprocating piston, scotch yoke compressor. More specifically, crankcase 22 includes four radially disposed cylinders, two of which are shown in FIG. 1 and designated as cylinder 30 and cylinder 32. The four radially disposed cylinders open into and communicate with a central suction cavity 34 defined by inside cylindrical wall 36 in crankcase 22. A relatively large pilot hole 38 is provided in a top surface 40 of crankcase 22. Various compressor components, including the crankshaft, are assembled through pilot hole 38. A top cover such as cage bearing 42 is mounted to the top surface of crankcase 22 by means of a plurality of bolts 44 extending through bearing 42 into top surface 40. When bearing 42 is assembled to crankcase 22, an O-ring seal 46 isolates suction cavity 34 from a discharge pressure space 48 defined by the interior of housing 12.

Crankcase 22 further includes a bottom surface 50 and a bearing portion 52 extending therefrom. Sleeve bearing 54 is retained within bearing portion 52. Likewise sleeve bearing 56 is provided in cage bearing 42, sleeve bearing 56 being in axial alignment with sleeve bearing 54. Sleeve bearings 54, 56 may be manufactured from steel-backed bronze. Journal portions 58, 60 receive the crankshaft (not shown) in a manner well known to those in the art. Journal portion 58 is received within sleeve bearing 54, and journal portion 60 is received within sleeve bearing 56. The crankshaft is rotatably journalled in crankcase 22 in the conventional manner, and extends through suction cavity 34.

Counterweight portion 62 and eccentric portion 64 of the crankshaft are located opposite one another with respect to the central axis of rotation of the crankshaft to thereby counterbalance one another. Eccentric portion 64 is operably coupled by means of a scotch yoke mechanism 66 to a plurality of reciprocating piston assemblies corresponding to, and operably disposed within, the four radially disposed cylinders in crankcase 22. As illustrated in FIG. 1, piston assemblies 68, 70, representative of four radially disposed piston assemblies operable in compressor assembly 10, are associated with cylinders 30, 32 respectively.

Scotch yoke mechanism 66 comprises a slide block 72 including a cylindrical bore 74 in which eccentric portion 64 is journalled. In a preferred embodiment, cylindrical bore 74 is defined by a steel backed bronze sleeve bearing press fit within slide block 72. A reduced diameter portion 76 in the crankshaft permits easy assembly of slide block 72 onto eccentric portion 64. Scotch yoke mechanism 66 also includes a pair of yoke members 78, 80 which cooperate with slide block 72 to convert rotating motion of the crankshaft and eccentric portion 64 to reciprocating movement of the four radially disposed piston assemblies. As shown in FIG. 1, yoke member 80 is coupled to piston assemblies 68, 70 so that when piston assembly 68 is at a bottom dead center position, piston assembly 70 will be at a top dead center position.

Each of piston assemblies 68, 70 comprises a piston member 82 having an annular piston ring 84 to allow piston member 82 to operably reciprocate within a cylinder to compress gaseous refrigerant therein. Piston member 82 also includes a mounting centerbore 86 extending therethrough. A plurality of suction ports 88 are circularly arranged around centerbore 86 and extend through piston member 82 to allow suction gas within suction cavity 34 to enter cylinder 30 on the compression side of piston 82.

Figure 3:
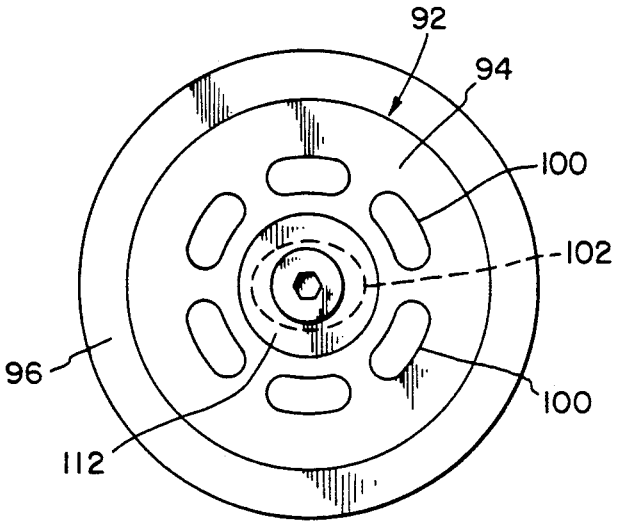
FIG. 3 is a view of the radially outer end of the piston and valve assembly according to the present invention.

A suction valve assembly 90 is associated with each piston assembly, thereby comprising a piston and valve assembly. Suction valve assembly 90 comprises a flat, generally disk-shaped suction valve 92 having a radially outer annular closure portion 94 (FIG. 3). In one version of the compressor, valve 92 is made of Swedish stainless steel and has a thickness of 0.020 inch. In its closed position, valve 92 covers suction ports 88 on outer top surface 96 of piston member 82. Valve 92 includes a central guide aperture 98 and a plurality of openings 100 circularly arranged around aperture 98 and radially inwardly from closure portion 94. Openings 100 allow suction gas entering through suction ports 88 to be directed around the outside and inside diameters of closure portion 94, thus reducing the amount of valve lift required. Suction valve 92 opens and closes by virtue of fluid pressure forces and/or its own inertia as piston assembly 68 reciprocates in cylinder 30.

Suction valve 92 is mounted generally circumjacent a guide member, such as elliptical spacer 102; that is, spacer 102 is received within aperture 98 of valve 92. Spacer 102, preferably formed from cold-rolled or case-hardened steel, is shown in dotted lines in FIG. 3. In operation, valve 92 slidingly rides along spacer 102, and is limited in its travel to an open position by valve retainer assembly 104. In one embodiment, valve 92 is free to reciprocatingly travel approximately 0.060 inch from its closed position adjacent outer top surface 96 of piston member 82, to an open position adjacent an undersurface of valve retainer assembly 104.

Figure 2:
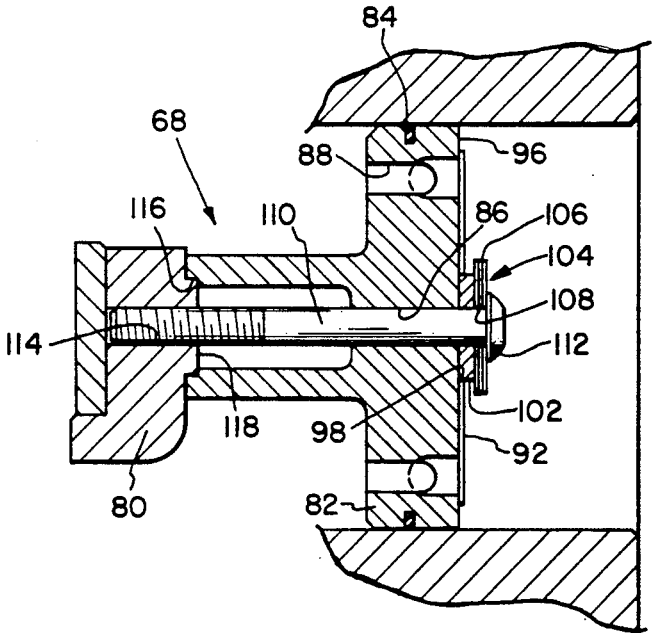
FIG. 2 is an enlarged sectional view of a piston and valve assembly of the compressor of FIG. 1, showing attachment of the piston assembly to a yoke member, and showing a valve retainer according to the present invention.
Figure 4:
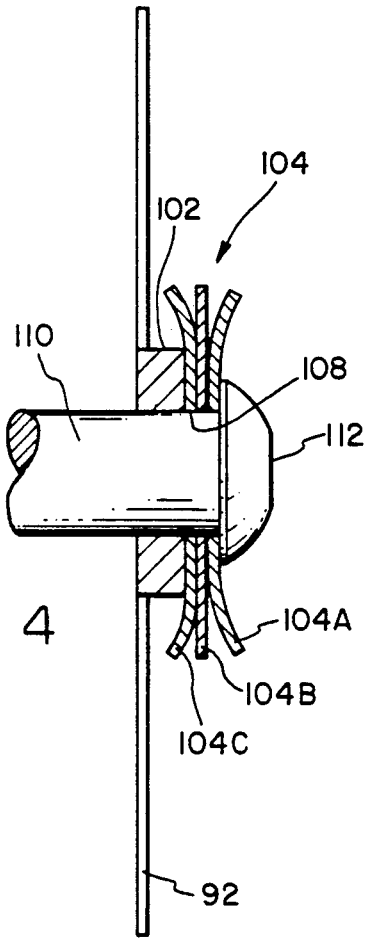
FIG. 4 is an enlarged view, partially in section, showing in exaggerated fashion the pre-loaded deflection of the valve retainer shown in FIG. 2.

Valve retainer assembly 104 comprises at least one washer 106, having a central aperture 108. In a preferred embodiment for large capacity compressors, valve retainer assembly 104 comprises two or more washers, stacked one atop another, as shown in FIGS. 2 and 4. Washers 106, suction valve 92, and spacer 102 are secured to top surface 96 of piston member 82 by an elongated threaded bolt 110 having a buttonhead 112. In the disclosed embodiment, the diameter of buttonhead 112 is greater than the respective diameters of aperture 108 in washers 106, which in turn is less than the outside diameter of spacer 102. Likewise, the respective outside diameters of washers 106 are greater than the diameter of guide aperture 98 in suction valve 92. Accordingly, washers 106 are retained between buttonhead 112 and spacer 102, while suction valve 92 is guidingly retained along spacer 102 between washers 106 and top surface 96. The piston and valve assembly of the present invention will be further described hereinafter, following the discussion regarding to the discharge valve assembly of the compressor assembly.

A discharge valve system is provided for discharging compressed gas through discharge ports in a valve plate. Discharge valve systems for hermetic compressors are well known to those skilled in the art, and the system described herein is representative of one of such systems. With reference to cylinder 32 in FIG. 1, a cylinder head cover 120 is mounted to crankcase 22, with a valve plate 122 interposed therebetween. A valve plate gasket 124 is provided between valve plate 122 and crankcase 22 to maintain clearance between suction valve 92 and a bottom surface 126 of valve plate 122 when the piston assembly is positioned at top dead center (TDC). Valve plate 122 includes recessed portion 123 into which buttonhead 112 of threaded bolt 110 is received when the piston assembly is at TDC. A discharge valve assembly 128 is situated on a top surface 130 of valve plate 122. Generally, compressed gas is discharged through a plurality of circularly arranged discharge ports (not shown) in valve plate 122, past an open discharge valve 132 that is limited in its travel by a discharge valve retainer 134. A pair of guide pins 136, 138 extend from valve plate 122 to an underside of cylinder head cover 120. Guide pins 136, 138 guidingly engage a pair of holes (not shown) in discharge valve 132 and discharge valve retainer 134, respectively, whereby discharge valve 132 and valve retainer 134 may be guidedly lifted away from valve plate top surface 130 in response to excessively high mass flow rates of discharge gas, or hydraulic pressures caused by slugging.

Top muffling chamber 140 communicates with a bottom muffling chamber 142 by means of passageways extending through crankcase 22. Chamber 142 is defined by an annular channel 144 and a muffler cover plate 146. Cover plate 146 is mounted against bottom surface 50 at a plurality of circumferentially spaced locations by bolts 148 and threaded holes 150. Grooves 152, 154 are provided in the crankshaft whereby lubricating oil is transported from a lubricant sump (not shown) to lubricate the seals as well as the sleeve bearings in a manner well known in the art. Counterweight 156, aligned with eccentric portion 64, is attached to the top of the crankshaft by means of an off center mounting bolt 158.

Figure 5:
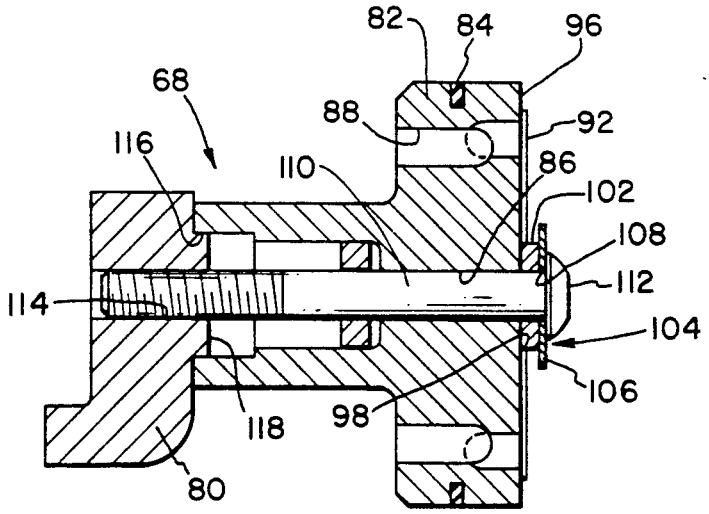
FIG. 5 is an enlarged sectional view of a piston and valve assembly of the compressor assembly of FIG. 1, showing another embodiment of the valve retainer.

With respect to the attachment of each piston assembly to a respective yoke member in accordance with the present invention, specific reference is made to piston assemblies 68, 70 and yoke member 80. Threaded bolt 110 is received within a threaded hole 114 in yoke member 80 to secure piston assembly 68 thereto. More specifically, as shown in the embodiments of FIGS. 2 and 5, an annular recess 116 is provided in each piston member and a complementary boss 118 is received within recess 116 to promote positive, aligned engagement therebetween.

Returning once again to the piston and valve assembly of the present invention, those skilled in the art are aware that retaining washers having a thickness of 0.060 inch have been used in hermetic compressors of the type to which the present invention generally pertains. While these prior art washers are generally effective as a "stop" for the suction valve during its reciprocating travel along spacer 102, the useful lifetime of such washers and/or suction valves may be adversely affected by the repeated impact of the suction valve against the washer. These prior art washers are also generally formed from a relatively stiff material or in some cases from spring steel having some flexibility, so that the retainer may have sufficient strength to withstand this repeated impact to the greatest extent that may reasonably be obtained. Nevertheless, this repetitive impact, often at high speed, may eventually cause a breakdown of the retainer and/or valve, resulting in the loss of operation of the compressor assembly.

It has been determined that by constructing the valve retainer of a more flexible material or a flexible material having a smaller thickness, that many of the problems associated with prior art retainers may be overcome. In the preferred embodiment illustrated in FIGS. 2 and 4 of the drawings, three washers 106 are stacked one atop another, as previously described. Washers 106 are made from a flexible material, such as high carbon spring steel of type C1090 or Swedish steel, for example, and have a diameter and thickness sufficient to act as a "stop" for the suction valve and, at the same time, to cushion and reduce the stress on the washer. Stresses on the valve are reduced as a result of the flexibility of the washer, as well as a result of the combined valve/washer flexibility, which reduces the deceleration of the valve at the point of impact. With reduced deceleration, impact forces and stresses are substantially reduced to levels which allow an improved endurance of the washer.

In the preferred three-washer embodiment, the washers comprising valve retainer 106 may have an individual thickness of 0.020 inch and aggregate thickness of at most 0.060 inch, preferably between 0.028–0.060 inch. The present inventors have found that satisfactory results may be obtained with, among others, respective aggregate thicknesses of 0.028 inch, 0.035 inch and 0.060 inch. Such dimensions are exemplary only, and other dimensions are possible.

Certain experiments have been performed in order to quantify the respective stiffnesses of various embodiments of the present invention, and compare the resulting data with that obtained using prior art retainers. Computer models of four valve stop designs were constructed. The respective stiffnesses of the suction valve retainers were determined by calculating the displacements at the outer edge of the stop for a 1 lbf applied uniformly around the edge of the retainer. Since the loading is symmetric, only a quarter model was used for the analysis. The model utilized was constrained at the planes of symmetry to model symmetry, and at the bolt head to prevent Z-translation.

A retainer comprising three washers, each having a thickness of 0.020 inch, was used in conjunction with an elliptical spacer. The retainer was mounted on the piston, with a screw 112 which was torqued to 40 in-lbs. This pre-load makes the top and bottom washers 104A and 104C bend outwardly in opposite direction, creating a small gap between the washers, which is shown in exaggerated fashion in FIG. 4. When the suction valve strikes the outer edge of the bottom washer 104C a force is exerted thereupon, thereby deflecting this washer so that it contacts the middle washer 104B. The middle washer in turn deflects and contacts the top washer 104A, assuming that sufficient load is applied. The valve retainer thus acts as a spring with a varying spring rate similar to that of leaf springs commonly used in automobiles. This action on the part of the washers is shown in FIG. 4 of the drawings.

To determine the combined stiffness of the plurality of washers at loads between 0 and 1000 lbf it was necessary to use gap elements between the washers at the contact surface. The gap elements provide a stiffness under compressive loads and remains open (no stiffness) under tensile loads. The model utilized in the testing was built using solid elements for the washers and the elliptical spacer. Gap elements were used in between the washers and the spacer. The first part of the analysis was to pre-load the stop with 40 in-lbf screw torque. This translates to a 1069.5 lbf tensile load in the screw which was applied as a nodal force distribution on the top washer. The model was constrained below the elliptical spacer in the Z-direction and with symmetry constraints along the planes of symmetry. Results of this analysis show a gap of 0.000271" between the top and middle washer and a gap of 0.000219" between the middle and bottom washer.

The second part of the analysis uses the calculated displacements of the screw pre-load case for the nodes on the top washer to maintain the pre-load and a known force at the edge of the bottom washer to calculate the stiffness. Several analysis runs were made by varying this force between 1 and 1000 lbs. Results of the analysis are shown in the accompanying Table. The following observations are made.

1) The stiffness of the three washer valve stop was also calculated as one washer with an equivalent thickness of 0.028". The stiffness calculated using this method was 51,282 lb/in. See Table.

The equivalent thickness in this case was calculated by using a formula derived from finite element theory:

$$t_{eg}=[t_1^3+t_2^3+t_3^3]^{\frac{1}{3}}=0.028''$$

2) Contact between the bottom and middle washers occurs when the suction valve exerts a force between 4 lbf and 5 lbf on the stop, and all three washers are in contact when this force reaches 11 lbf. The stiffness of the valve stop at these loads is shown in the Table.

TABLE

SF SUCTIO VALVE STOP STIFFNESS

| SAMPLE | DESCRIPTION | THICKNESS | LOAD | DISPLACEMENT | STIFFNESS |
|---|---|---|---|---|---|
| 1 | WASHER | 0.035 | 1 | 0.00001160 | 85,763 |
| 2 | WASHER | 0.060 | 1 | 0.00000301 | 331,785 |
| 3 | WASHER/SPACER COMBINATION STOP | 0.060 | 1 | 0.00000164 | 610,128 |
| 4 | WASHER - EQUIVALENT TO THREE WASHERS OF 0.020 THICK EACH | 0.028 | 1 | 0.00001950 | 51,282 |
| 5 | THREE WASHERS | 0.020 EA | 1 | 0.00006739 | 14,839 |
| | " | " | 5 | 0.00032132 | 15,557 |
| | " | " | 10 | 0.00051865 | 19,280 |
| | " | " | 11 | 0.00055332 | 19,879 |
| | " | " | 12 | 0.00057556 | 20,850 |
| | " | " | 15 | 0.00064297 | 23,329 |

TABLE-continued

| SF SUCTIO VALVE STOP STIFFNESS | | | | | |
|---|---|---|---|---|---|
| SAMPLE | DESCRIPTION | THICKNESS | LOAD | DISPLACEMENT | STIFFNESS |
| | " | " | 20 | 0.00075537 | 26,476 |
| | " | " | 50 | 0.00135625 | 36,866 |
| | " | " | 100 | 0.00222128 | 45,019 |
| | " | " | 300 | 0.00554795 | 54,074 |
| | " | " | 500 | 0.00888936 | 56,247 |
| | " | " | 1000 | 0.01724271 | 57,995 |

Samples 2 and 3 represent prior art designs, whereas Samples 1, 4 and 5 represent designs according to the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A piston and valve assembly for a hermetic compressor, wherein the hermetic compressor includes a crankcase having a cylinder therein, said piston and valve assembly comprising:

a piston reciprocable in said cylinder, said piston having a top surface;

a valve member disposed generally adjacent said top surface and being displaceable a fixed distance therefrom;

flexible valve retainer means spaced said fixed distance from said piston top surface, said flexible valve retainer means having a thickness less than 0.060 inch and having a stiffness less than 331,000 lbf/in; and means associated with said piston and said valve retainer means for maintaining said valve retainer means at said fixed distance from said top surface.

2. The piston and valve assembly of claim 1, wherein said flexible valve retainer means comprises at least one annular washer spaced said fixed distance, said at least one annular washer having an aggregate thickness between 0.020 and 0.060 inch.

3. The piston and valve assembly of claim 2, wherein said washer is made of spring steel.

4. The piston and valve assembly of claim 1, wherein said flexible valve retainer means comprises an annular washer, said annular washer being generally coaxial with said valve member and spaced said fixed distance therefrom, said annular washer having a thickness equal to or less than 0.035 inch and a stiffness less than 85,000 lbf/in.

5. The piston and valve assembly of claim 4, wherein said washer is aligned so that said suction valve member impacts thereagainst as said valve member is displaced from a closed position adjacent said top surface to an open position axially spaced said fixed distance from said top surface, said washer having a radially outer portion, whereby said radially outer portion is deflectable upon impact.

6. The piston and valve assembly of claim 1, wherein said flexible valve retainer means comprises an annular washer, said washer being generally coaxial with said valve member and spaced said fixed distance therefrom, said annular washer having a thickness equal to or less than 0.028 inches and a stiffness less than 51,000 lbf/in.

7. The piston and valve assembly of claim 1, wherein said flexible valve retainer means comprises a plurality of retainer members, said retainer members being positioned in stacked relationship one atop another, said retainer members further being generally coaxial with said valve member and spaced said fixed distance therefrom.

8. The piston and valve assembly of claim 7, wherein said plurality of retainer members comprises at least two washers.

9. The piston and valve assembly of claim 8, wherein said plurality of retainer members comprises three washers.

10. The piston and valve assembly of claim 7, wherein said retainer members are aligned so that said suction valve member impacts against a bottommost of said retainer members as said valve member is displaced from a closed position adjacent said top surface to an open position axially spaced said fixed distance from said top surface, said retainer members having respective radially outer portions, whereby said radially outer portions are deflectable upon said impact.

11. The piston and valve assembly of claim 10, wherein the radially outer portions of the retainer members are spaced slightly from each other in an axial direction with respect to the axis of reciprocation of the piston.

12. The piston valve assembly of claim 11, wherein there are at least two said retainer members and wherein the radially outer portions of each of them are spaced axially from each other.

13. A piston and valve assembly for a hermetic compressor, said compressor including a crankcase having a cylinder therein, and further including a suction cavity defined by an inside wall of said crankcase, said piston and valve assembly comprising;

a piston reciprocable in said cylinder for compressing gaseous refrigerant therein, said piston having a plurality of suction ports extending therethrough from a top surface to a bottom surface thereof whereby said gaseous refrigerant passes into said cylinder from said suction cavity by way of said suction ports;

a suction valve member operably mounted to said top surface and coaxial therewith, said suction valve member being axially displaceable from a closed position adjacent said top surface whereby said suction ports are covered by said valve member to an open positions axially spaced a fixed distance from said top surface, said cylinder being in fluid communication with said suction cavity when said suction valve member is in said open position;

flexible valve stop means axially spaced said fixed distance from said top surface, said valve stop means being sized and configured to limit the displacement of said suction valve member from said closed position to said open position as a result of impact therebetween, said flexible valve stop means comprising a plurality of generally annular retainer members, said retainer members being stacked one atop another and being axially aligned with said top surface, said stacked retainer members having a radially outer portion and a radially inner portion, said radially outer portion being deflectable upon said impact of said valve member and having a stiffness wherein said stiffness increases with an increase in said deflection.

14. The piston and valve assembly of claim 13 wherein said plurality of retainer members has an aggregate thickness of 0.040 to 0.060 inch.

15. The piston and valve assembly of claim 13, wherein the radially outer portions of the retainer members are spaced slightly from each other in an axial direction with respect to the axis of reciprocation of the piston.

16. A piston and valve assembly in a hermetic compressor, said compressor including a crankcase having a cylinder therein, said piston and valve assembly comprising;

a piston reciprocable in said cylinder for compressing gaseous refrigerant therein, said piston having a plurality of suction ports extending therethrough from a top surface to a bottom surface thereof whereby said gaseous refrigerant passes into said cylinder from a suction cavity by way of said suction ports, said suction cavity being defined by an inside wall of said crankcase;

a suction valve member generally adjacent said top surface and axially aligned therewith, said suction valve member being reciprocatingly displaceable from a closed position adjacent said top surface whereby said suction ports are covered by said valve member to an open position axially spaced a fixed distance from said top surface, said cylinder being in fluid communication with said suction cavity when said suction valve member is in said open position;

flexible valve retainer means axially spaced said fixed distance from said top surface and generally coaxial therewith, said valve retainer means comprising a plurality of generally annular washers, said washers being of generally similar diameter and thickness and being positioned in stacking relationship one atop another, said valve retainer means being aligned so that said suction valve member impacts thereagainst as said valve member is displaced from said closed position to said open position, said valve retainer means being deflectable upon said impact and having a stiffness wherein said stiffness increases with an increase in said deflection, said stiffness being less than 331,000 lbf/in.; and means in registry with said piston and said valve retainer means for maintaining said valve retainer means at said fixed distance from said piston top surface.

17. The piston and valve assembly of claim 16, wherein said stiffness is less than 85,000 lbf/in.

18. The piston and valve assembly of claim 16, wherein said stiffness is less than 51,000 lbf/in.

19. A piston and valve assembly for a hermetic compressor, wherein the hermetic compressor includes a crankcase having a cylinder therein, said piston and valve assembly comprising:

a piston reciprocable in said cylinder, said piston having a top surface;

a valve member disposed generally adjacent said top surface and being displaceable a fixed distance therefrom;

flexible valve retainer means spaced said fixed distance from said piston top surface, said flexible valve retaining means having a stiffness less than 331,000 lbf/in; and means associated with said piston and said valve retainer means for maintaining said valve retainer means at said fixed distance from said top surface.

20. The piston and valve assembly of claim 19, wherein the stiffness of said valve retainer means is less than 85,000 lbf/in.

21. The piston and valve assembly of claim 19, wherein the stiffness of the valve retainer means is less than 58,000 lbf/in.

22. The piston and valve assembly of claim 19, wherein the stiffness of said valve retainer means is less than about 51,000 lbf/in.

* * * * *